US007340789B2

(12) United States Patent
Cloward

(10) Patent No.: US 7,340,789 B2
(45) Date of Patent: Mar. 11, 2008

(54) OVER-BED SUPPORT STRUCTURE

(76) Inventor: Davis Lisandro Cloward, 307 N. Holden Rd., Greensboro, NC (US) 27410

( * ) Notice: Subject to any disclaimer, the term of this patent is extended or adjusted under 35 U.S.C. 154(b) by 1 day.

(21) Appl. No.: 11/339,596

(22) Filed: Jan. 25, 2006

(65) Prior Publication Data

US 2007/0169277 A1 Jul. 26, 2007

(51) Int. Cl.
*A47C 31/00* (2006.01)

(52) U.S. Cl. ..... 5/929; 5/414

(58) Field of Classification Search ..... 5/929, 5/414–416, 658, 907; 135/96, 121, 157, 135/161

See application file for complete search history.

(56) References Cited

U.S. PATENT DOCUMENTS

| | | | | | |
|---|---|---|---|---|---|
| 117,370 | A | * | 7/1871 | Bates | 135/121 |
| 130,163 | A | * | 8/1872 | Stoltz | 135/121 |
| 259,337 | A | * | 6/1882 | Smith | 135/161 |
| 325,464 | A | * | 9/1885 | Watson | 135/96 |
| 356,015 | A | * | 1/1887 | Steinberg | 135/154 |
| 372,570 | A | * | 11/1887 | Segar | 135/157 |
| 654,156 | A | * | 7/1900 | Johnson | 135/90 |
| 671,912 | A | * | 4/1901 | Woodward | 135/90 |
| 677,672 | A | | 7/1901 | Libby | |
| 699,835 | A | * | 5/1902 | Chorlton | 5/113 |
| 739,352 | A | | 9/1903 | Schuette | 5/414 |
| 785,571 | A | | 3/1905 | Raines et al. | 135/142 |
| 875,206 | A | * | 12/1907 | Osborne | 135/157 |
| 1,021,930 | A | | 4/1912 | Jackson | 135/121 |
| 1,254,529 | A | * | 1/1918 | Panganiban | 135/121 |
| 1,495,988 | A | * | 6/1924 | Catino | 5/96 |
| 1,737,664 | A | * | 12/1929 | Maness | 135/142 |
| 2,690,186 | A | * | 9/1954 | Ball | 5/415 |
| 3,237,217 | A | | 3/1966 | Desneux | 5/362 |
| 3,311,118 | A | | 3/1967 | Gutner | 135/5.2 |
| 3,668,722 | A | | 6/1972 | Gallant | |
| 3,741,225 | A | | 6/1973 | Gunter | 135/5.2 |
| 3,855,652 | A | | 12/1974 | Nickolson | |
| 3,971,592 | A | | 7/1976 | Farley | |
| 4,069,527 | A | | 1/1978 | Harris | |
| 4,099,773 | A | | 7/1978 | Chang | |
| 4,122,567 | A | | 10/1978 | Hanson | |
| D256,526 | S | * | 8/1980 | Johnson | D6/389 |
| 4,373,222 | A | | 2/1983 | Wolfe et al. | |
| 4,571,761 | A | | 2/1986 | Perlin | |
| 4,641,387 | A | | 2/1987 | Bondy et al. | 5/508 |
| 4,779,294 | A | | 10/1988 | Miller | |
| 4,782,541 | A | | 11/1988 | Tuchman | |
| 4,825,855 | A | | 5/1989 | Kundson, Jr. | |
| 4,884,842 | A | | 12/1989 | Finkelstein | |
| 4,958,391 | A | | 9/1990 | Egeland | 5/127 |
| 4,965,895 | A | | 10/1990 | Shustov | |
| 5,241,717 | A | | 9/1993 | Ward et al. | |

(Continued)

OTHER PUBLICATIONS

U.S. Publication No. US2005/0114995—Nakata, et al.

*Primary Examiner*—Robert G. Santos
(74) *Attorney, Agent, or Firm*—MacCord Mason PLLC

(57) ABSTRACT

A structure positioned over a bed and able to support up to 200 pounds, which allows persons involved in sexual intercourse to position their bodies in ways that may be more comfortable, or more pleasurable, if one of the participants is able to support some or all of their weight from the overhead apparatus.

4 Claims, 4 Drawing Sheets

U.S. PATENT DOCUMENTS

| | | | | |
|---|---|---|---|---|
| 5,280,794 | A | 1/1994 | Degen | |
| 5,384,925 | A | 1/1995 | Vail | 5/424 |
| 5,453,080 | A | 9/1995 | Mitchum, Jr. | |
| 5,507,046 | A | 4/1996 | Taylor | 5/414 |
| 5,615,424 | A * | 4/1997 | Nakata | 5/2.1 |
| 5,662,132 | A | 9/1997 | Larsen | 135/96 |
| 5,718,254 | A * | 2/1998 | Murphy | 135/96 |
| 5,737,784 | A | 4/1998 | Jackman | |
| 5,782,243 | A | 7/1998 | Bisyak | |
| 5,784,732 | A | 7/1998 | Vail | 5/430 |
| 5,875,779 | A | 3/1999 | Furman et al. | |
| 5,971,480 | A | 10/1999 | Maschke | |
| D417,089 | S | 11/1999 | McDaniel et al. | D6/389 |
| D418,691 | S | 1/2000 | O'Hare | D6/389 |
| 6,030,039 | A | 2/2000 | Essler | |
| 6,101,652 | A | 8/2000 | Matern, Jr. | |
| 6,199,552 | B1 | 3/2001 | Crespo | |
| 6,216,291 | B1 | 4/2001 | Eads et al. | 5/424 |
| D443,152 | S | 6/2001 | O'Hare et al. | D6/389 |
| 6,263,529 | B1 | 7/2001 | Chadwick et al. | 5/414 |
| 6,338,344 | B1 | 1/2002 | Sinohui, Jr. | |
| 6,487,735 | B1 | 12/2002 | Jacques, II et al. | 5/424 |
| 6,687,930 | B1 * | 2/2004 | Eads et al. | 5/414 |
| 6,694,547 | B1 | 2/2004 | Vail | 5/424 |
| 6,698,431 | B1 | 3/2004 | Harris et al. | |
| 6,715,168 | B2 * | 4/2004 | Williams | 5/414 |
| 6,745,774 | B2 | 6/2004 | Fessler | |
| 6,772,458 | B2 * | 8/2004 | Ellen et al. | 5/424 |
| 6,925,669 | B1 | 8/2005 | Friedman et al. | |
| 6,926,006 | B2 | 8/2005 | Black | |
| 2003/0126686 | A1 | 7/2003 | Nash | |
| 2003/0145378 | A1 * | 8/2003 | Williams | 5/113 |
| 2003/0233707 | A1 | 12/2003 | East | |
| 2005/0011006 | A1 * | 1/2005 | Ellen et al. | 5/424 |
| 2005/0081296 | A1 | 4/2005 | Dawes | |
| 2007/0169263 | A1 * | 7/2007 | Cloward | 5/414 |
| 2007/0169277 | A1 * | 7/2007 | Cloward | 5/929 |

* cited by examiner

OVER-BED SUPPORT STRUCTURE

CROSS-REFERENCE TO RELATED APPLICATIONS

Not applicable

FEDERALLY SPONSORED RESEARCH OR DEVELOPMENT

Not applicable

APPENDIX OR ATTACHMENTS

Not applicable

BACKGROUND OF THE INVENTION

1. Field of the Invention

This invention relates generally to furniture whose function is to enhance sexual pleasure (U.S. CL. 5/929), and specifically to a supportive structure enhancing the function of a bed (U.S. CL. 5/503.1; 128/845).

BACKGROUND OF THE INVENTION

The desire to enhance the pleasure inherent in sexual intimacy has given rise to many products. Among them are suspensory apparatus designed to increase mobility and improve positioning. Some of these apparatus require suspension from the ceiling or a specialized frame, for example U.S. Pat. No. 4,825,855, Kundson, Jr., May 2, 1989, and U.S. Pat. No. 5,782,243, Bisyak, Jul. 21, 1998 (marketed successfully as The Love Swing®). Others depend on tubular supporting structures that do not readily lend themselves to placement over a bed, for example U.S. Pat. No. 5,280,794, Degen, Jan. 2, 1994, and U.S. patent application Ser. No. 20030126686, Nash, Jul. 10, 2003 (marketed as The LoveRocker).

No simple and aesthetically pleasing means for supporting these or similar apparatus is available. The apparatus themselves are not furniture in a traditional sense. Most are difficult if not impossible to utilize over a bed. This invention provides an attractive supportive structure, which allows the use of the above-mentioned suspensory apparatus over a bed without the need for a separate and obtrusive frame.

2. Prior Art

Sexually Assistive Apparatus

Previously patented sexually assistive apparatus rarely represent inventions that a typical consumer would classify as furniture. Most are contraptions that appear mechanical, resembling joined bicycle frames (U.S. Pat. No. 6,745,774, Fessler, Jun. 8, 2004). Some appear more suitable for torture than pleasure or romance (U.S. Pat. Nos. 5,453,080, Mitchum, Jr., Sep. 26, 1995, and 5,875,779, Fuhrman, et al., Mar. 2, 1999). The following are but a few of the available examples: U.S. Pat. Nos. 6,926,006, Black, Aug. 9, 2005; 6,698,431, Harris, et al., Mar. 2, 2004; 6,030,039, Essler, Feb. 29, 2000; 4,373,222, Wolfe, et al., Feb. 15, 1983; 4,099,773, Chang, Jul. 11, 1978; 3,971,592, Farley, Jul. 27, 1976. Most people would not buy such contraptions for fear of embarrassment. In general, they do not satisfy a need for furniture that is at once functional, aesthetically pleasing, and acceptable for public display. There are a few exceptions. U.S. Pat. No. 3,855,652, Nicholson, Dec. 24, 1974, is a couch placed at the foot of a bed that provides support for one individual's feet and for their partner's knees. U.S. Pat. No. 4,884,842, Finkelstein, Dec. 5, 1989, is a design for a curved stool that allows access to the genitalia of the person seated on it. U.S. Pat. No. 6,338,344, Sinohui, Jr., Jan. 15, 2002, is a variation of a common chair design. It can be used to achieve several sexual positions that may not be as comfortable on a standard chair.

However, there remains a long-felt and incompletely solved need for furniture that is able to provide greater freedom in sexual activity yet does not need to be hidden from view when not in use.

Prior Art:

Designs that Enhance the Function of a Bed

Beds, or their accessories, have been specifically designed to help us read more comfortably, to watch TV, work on computers, or eat there. However, when two adults are known to share a bed, it is not generally assumed that they do so to eat, or to work on their computers. Rather, the assumption is that they will both sleep on the bed as well as participate in sexual activity on the bed. In our society, our beds are where we perform the majority of our sexual acts. Even so, beds do not particularly serve this function well.

The following is a sampling of the many attempts to design beds, or bed accessories, with the goal of enhancing sexual pleasure or positioning. Perlin (U.S. Pat. No. 4,571,761, Feb. 25, 1986) and Hanson (U.S. Pat. No. 4,122,567, Oct. 31, 1978) among others designed mattresses that allow for more variety in body positioning during sexual intercourse. These designs present significant impediments to the use of bed linens. U.S. Pat. No. 6,925,669, Friedman, et al., Aug. 9, 2005 comprises a system of supportive cushions, typically placed on a bed. These cushions support the hips of their user off the surface of the bed. This system is currently marketed successfully as The Liberator®. Libby (U.S. Pat. No. 677,672, Jul. 2, 1901), Matern, Jr. (U.S. Pat. No. 6,101,652, Aug. 15, 2000) and Dawes (U.S. patent application Ser. No. 2005/0081296 A1, Apr. 21, 2005) attached stirrups to a standard bed. These must be positioned at the edge of the mattress, which limits their utility. U.S. Pat. No. 3,668,722, Gallant, Jun. 13, 1972 is self-described as a "cradle" that can be placed on a bed to hold the weight of one partner over the other. Though it is possible that it will actually perform its stated function, this item does not appear particularly comfortable or easy to use, and may collapse on its users.

The above examples suggest that the USPTO declaration that a "conventional bed" is "inherently adapted to facilitate sexual relations" is an assumption that needs reconsideration. There are some positions for sexual relations that cannot be achieved comfortably, or cannot be maintained comfortably on a regular bed. It is a cultural phenomenon, coupled with convenience, that has determined that our beds are where most of us experience the majority of our sexual activity. However, the fact that we use our beds for sex does not mean that they are particularly well designed for this activity. With minimal imagination, it is possible to identify multiple ways for a couple to interact sexually that would be difficult or uncomfortable in a conventional bed. The plurality of inventions for enhancing sexual activity speaks to a widely held desire for a functional enhancement over what is inherently provided by a conventional bed.

Prior Art: Supportive Element over a Bed

Supportive structural elements over a bed have been previously devised and utilized. Most of these are only decorative or support decorative elements such as drapery, or mosquito netting, and cannot safely support the weight of an adult human.

Other, more substantial structures have been designed for use with a bed in order to assist in lifting or positioning an infirm person, and for specific surgical procedures. These include the many variations of trapeze apparatus over a "hospital bed". While these structures and their accessories could possibly be utilized for sexual activity, they are not designed for this purpose. Neither are they satisfactory as attractive bedroom furniture.

Substantial supportive structures unrelated to health care have been described, such as U.S. Pat. No. 5,241,717, Ward et al., Sep. 7, 1993, that purports to protect the occupants of the underlying bed from falling debris during a catastrophe such as an earthquake. Other similar inventions follow: U.S. Pat. No. 5,737,784, Jackman, Apr. 14, 1998; U.S. Pat. No. 4,965,895, Shustov, Oct. 30, 1990; U.S. Pat. No. 4,782,541, Tuchman, Nov. 8, 1988; U.S. Pat. No. 4,779,294, Miller, Oct. 25, 1988; U.S. Pat. No. 4,069,527, Harris, Jan. 24, 1978. These devices fulfill their respective, particular objectives, yet none of these are aesthetically pleasing structures marketable as means to enhance their user's sexual pleasure.

BACKGROUND OF THE INVENTION

Objects and Advantages

The over-bed support structure fills the need for a piece of bedroom furniture that allows its users to safely improvise a greater range of sexual positions than possible on a standard bed, yet without appearing to be a sexual apparatus.

This over-bed structure advances the art by providing a structure that (a) is able to support the weight of a human adult during sexual activity (b) allows greater variety in attainable and comfortable bodily positions through grasping the invention directly (c) accepts the attachment of accessories designed to support the weight of an adult during sexual activity (d) is an acceptable decorative piece of bedroom furniture.

This over-bed support structure provides a means for an adult to sit, or kneel, astride of their sexual partner's face or pelvis while supporting their own weight, by holding on to the overhead structure. The over-bed support structure may also be utilized to suspend one or both of the legs of an adult, via straps attached to the structure, thereby enabling their partner comfortable access to their genitalia. Previously referenced suspensory apparatus such as "swings" and "chairs" can be adapted for use with the structure. Other sexual positions enabled by this invention include kneeling face to face, or front to back, with one or both partners stabilizing their bodies by grasping the canopy structure. It is central to the invention that the canopy and supporting posts of the bed be capable of withstanding the structural load of the weight of an adult body.

BRIEF SUMMARY OF THE INVENTION

An overhead structure for a bed, designed to increase the options available to its users in positioning their bodies while performing sexual acts. Minimally, the overhead structure consists of a framework, and its supporting elements, positioned over a bed and able to support the weight of a person weighing up to 200 pounds.

This over-bed support structure allows persons involved in sexual intercourse to position their bodies in ways that may be more comfortable, or more pleasurable, if one of the participants is able to support some or all of their weight from an overhead apparatus. This over-bed support structure functions in conjunction with other inventions, which enhance the functionality of the over-bed support structure through the attachment of suspensory apparatus to the over-bed support structure.

The type of material used in fabricating the structure does not have a direct bearing on the invention. Structural members may be made of steel, aluminum, plastic, fiberglass, wood, composite materials or any other suitable material or combination of materials.

The arrangement of the structural members may also vary, depending on the innate requirements of the materials used, or on aesthetic considerations applicable to the bed itself or to styles of bedroom furniture the structure is applied to. The method of supporting this structure may also vary, though in most cases its application will be as a canopy over a four-poster bed. However, it may also be suspended from a separate supporting structure, or from the ceiling, or from structural members in the ceiling. Alternately, it may be cantilevered from the bed frame, or from a separate structure, or from a wall, or from structural members in a wall.

Commercially, the over-bed support structure will find its application primarily as an integral component of a four-poster bed. It is possible to retrofit this over-bed support structure to an existing four-poster bed. However, most existing four-poster beds do not have the structural integrity to support both this over-bed support structure and the weight of a human adult, much less the stability to withstand any lateral forces produced by the movements of its user's bodies. Because of this, the over-bed support structure is presented in the appended drawings as an integral part of a four-poster bed that was designed in conjunction with it.

DETAILED DESCRIPTION OF THE INVENTION

The above described drawings illustrate some embodiments of the invention. The following description, in conjunction with the drawings, is presented to enable anyone of ordinary skill in the art to make and use the invention. Various modifications, and variations in use and application, will be readily apparent to those skilled in the art. The general principles defined in the appended claims may be applied to a wide range of embodiments. Thus the invention is not intended to be limited to the aspects presented, but is accorded the widest scope consistent with the novel principles and features disclosed herein.

Figure 1:
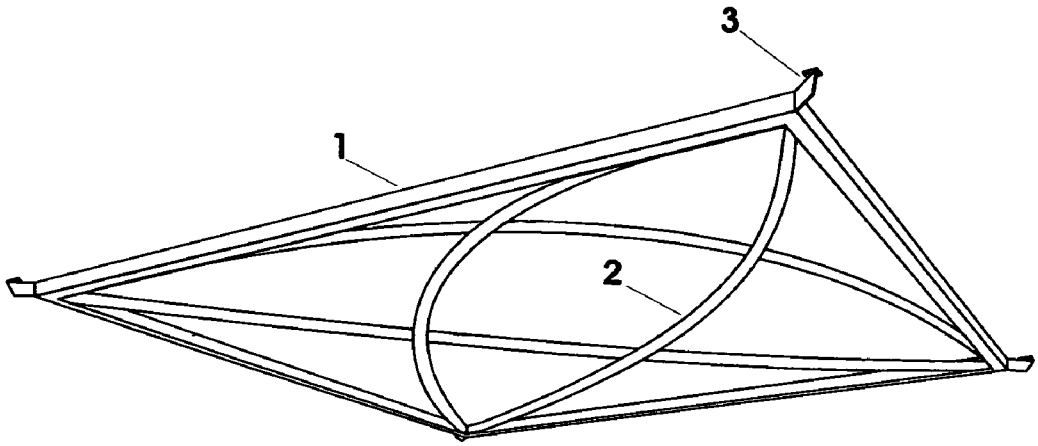
FIG. 1 is an embodiment of the over-bed support structure as a tubular structure attachable at its corners to vertical elements. It is seen in perspective from its undersurface.
Figure 2A:
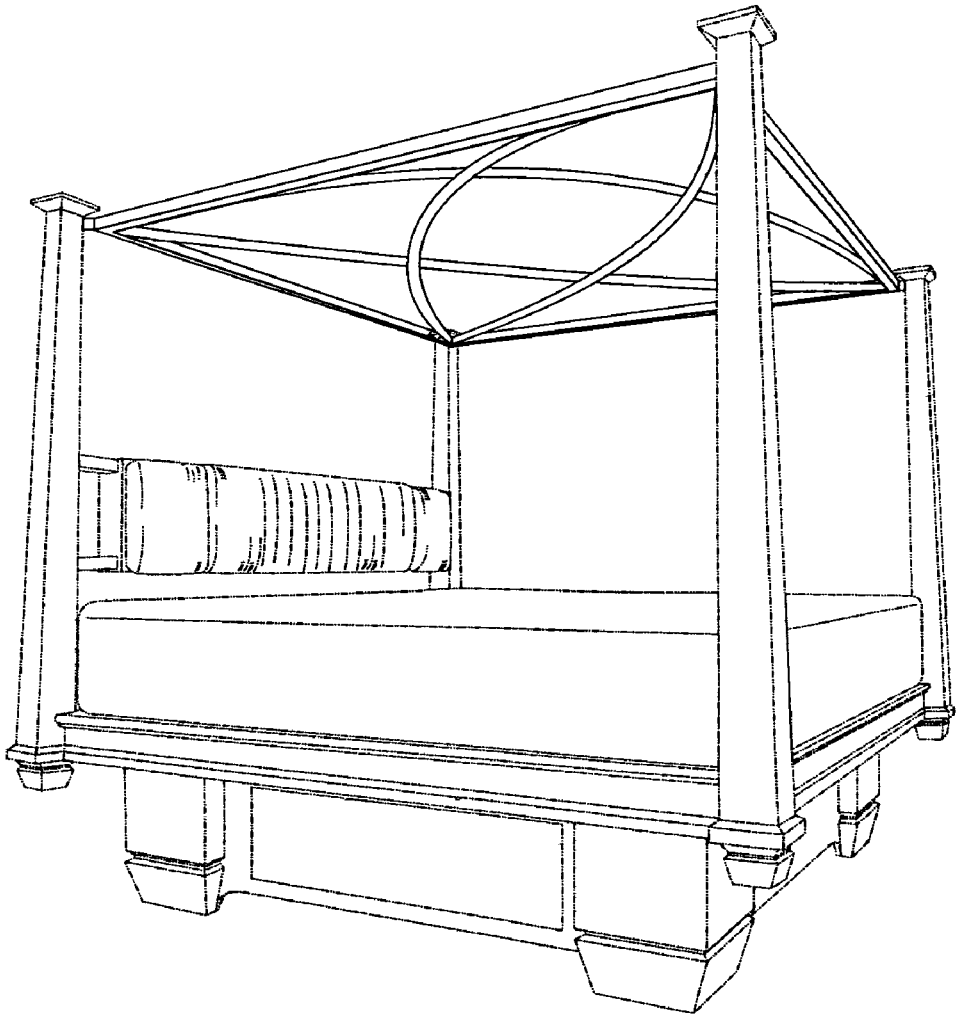
FIG. 2A shows the over-bed support structure as a component of a four-poster bed.
Figure 2B:
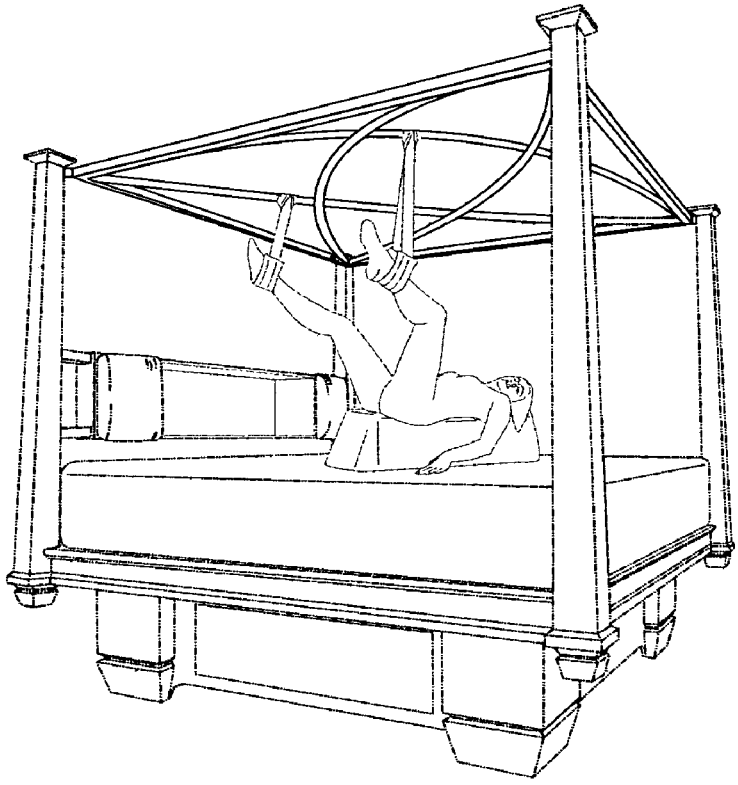
FIG. 2B demonstrates the use of the over-bed support structure for the attachment of suspensory apparatus. In this expression of its use, the individual depicted is also elevated off the surface of the mattress on a cushion.
Figure 2C:
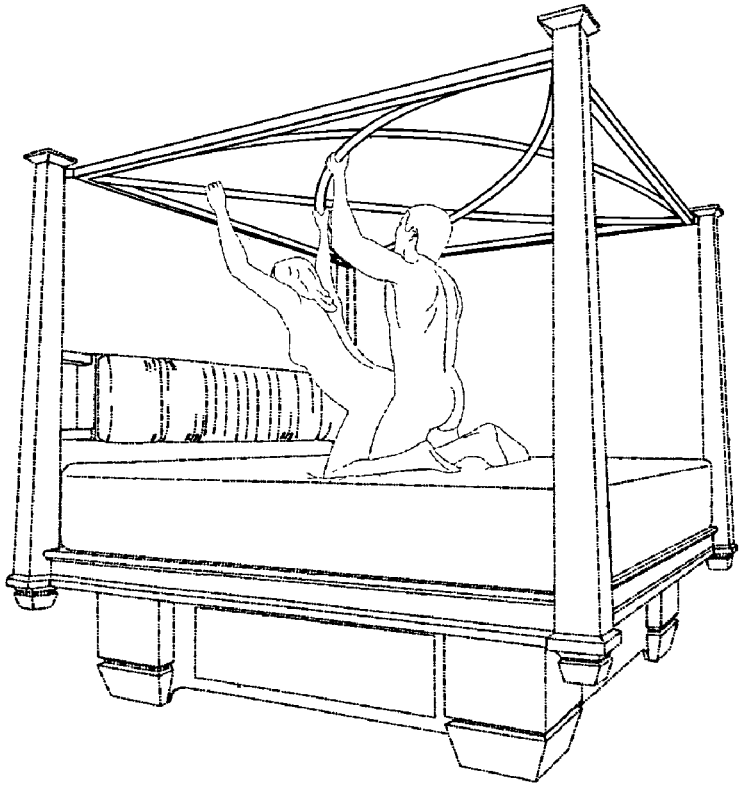
FIG. 2C demonstrates how its users may grasp the over-bed support structure during sexual intimacy.
Figure 3:
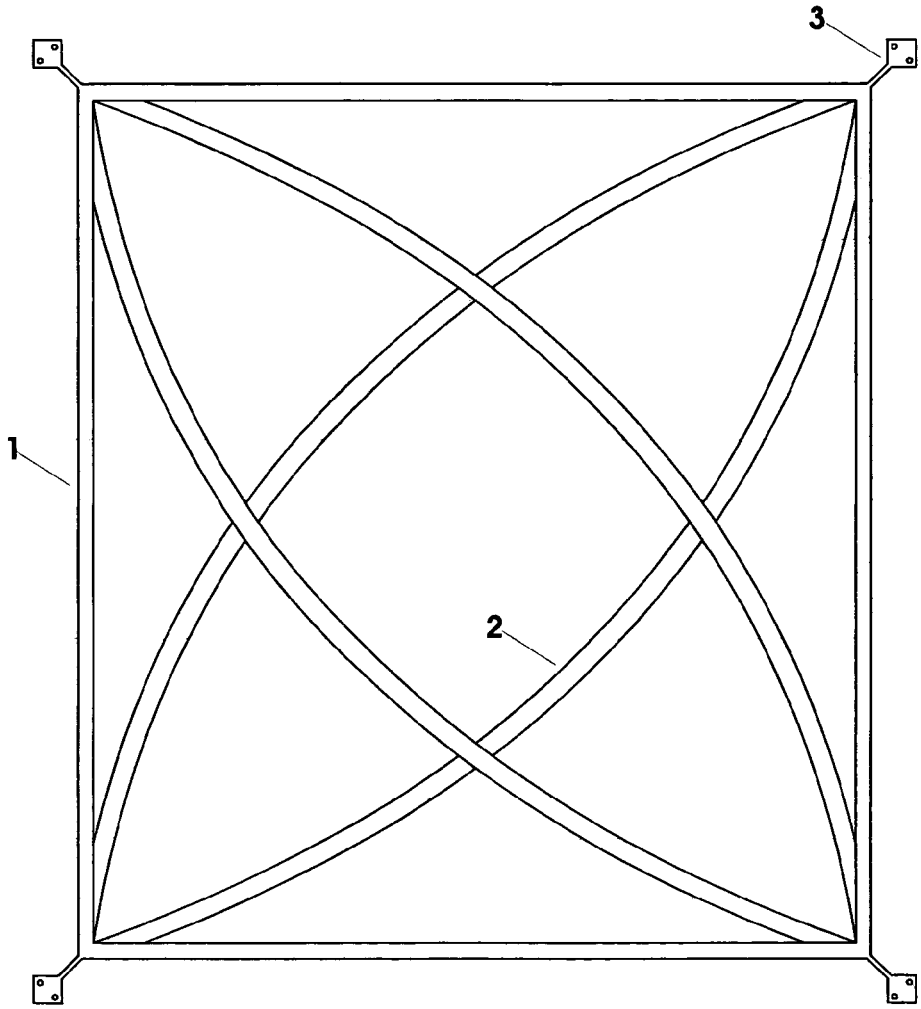
FIG. 3 is a plan view of this specific embodiment.
Figure 4:
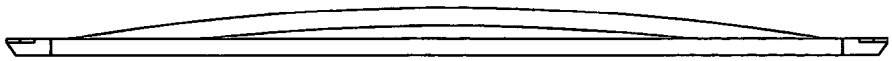
FIG. 4 is an elevation view of this specific embodiment.

The embodiment in FIG. 1 is constructed out of rolled steel tubes in the illustrated arrangement. The straight tubes that form the periphery 1 are square in cross section while the curved tubes that form the central latticework 2 are round in cross section. The joints depend on beveled cuts in the steel tubes welded to create a rigid frame. The outside corners have projections 3 made of welded flat steel plate. The projections from the corners are placed into slots prepared in the bedposts and then attached to the posts via screws. The entire structure is of sufficient strength to support 200 lbs. suspended at the center of the apparatus. The tubes are arranged in relation to each other such that there are several openings with adequate space between the tubes through which a man or woman is able to stand and project their upper torso. The tubes have sufficient diameter and are finished in such a way as to be easily clasped by a bare hand. The entire apparatus is placed over a bed at a height that allows its users to comfortably clasp the structure while either sitting of kneeling on the surface of the bed.

Figure 5:
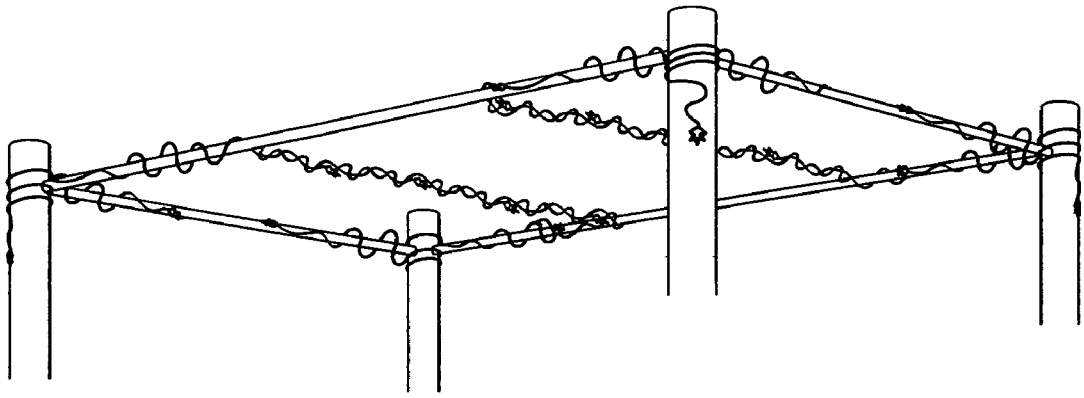
FIGS. 5 and 6 are alternate embodiments. These drawings describe two alternative embodiments of the invention but are not intended to limit the invention to these specific embodiments. The scope of the invention is to be interpreted only in conjunction with the appended claims.
Figure 6:
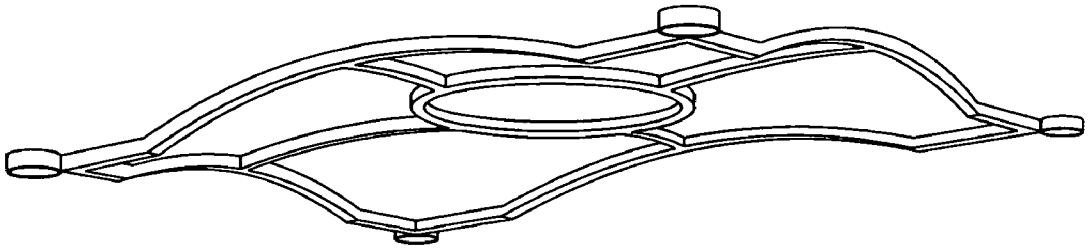

Additional embodiments illustrated in FIGS. 5 and 6 are but two of many possible embodiments. The over-bed support structure may have other shapes, such as, but not limited to, circular, oval, trapezoidal, triangular, or combinations of these. The materials, and joints used for its construction are limited only by the ability of a material and any joint to fulfill the basic requirements detailed in the appended claims. Thus the scope of the invention should be determined by the appended claims and their legal equivalents, rather than by the examples given.

The invention claimed is:

1. A structure for use over a bed, comprising:

(a) a plurality of members in a predominantly horizontal array configured to be arranged above a top of a mattress on the bed;

(b) the material composition and cross-sectional design of said array of members adequate to support as a minimum the weight of an adult human, assumed to be approximately 200 pounds;

(c) the members being joined together in the array such that (1) said members form a unit which as a whole is capable of supporting as a minimum 200 pounds of weight of an adult human;

(2) there are one or more spaces between said members through which an adult is able to extend his or her body;

(3) some of said members can be comfortably clasped by an adult who is in a sitting or kneeling position on said mattress; and (d) suspensory apparatus attached to and having portions hanging below the array useful for sexual activity.

2. A structure as claimed in claim 1, wherein the suspensory apparatus has a handle for a person to grasp and being strong enough to support a 200 pound weight of a human.

3. A structure for use over a bed, comprising:

a plurality of members in a predominantly horizontal array, the array including a plurality of plates extending outward from corners of the array configured to attach to bedposts;

the material composition and cross-sectional design of said array of members adequate to support as a minimum the weight of an adult human, assumed to be approximately 200 pounds;

the members being joined together in the array such that the members form a unit which as a whole is capable of supporting as a minimum 200 pounds of weight of an adult human; there are one or more body-part-receiving spaces between the members through which an adult is able to extend his or her body; and some of members can be comfortably clasped by an adult who is in a sitting or kneeling position on said bed.

4. An improved bed, comprising:

a base providing a first area for receiving a mattress and retaining the mattress so that the mattress has a top at a first level;

corner posts connected to the base below the first area for receiving a mattress, rails extending between ones of the corner posts to support a mattress, the corner posts having extensions upward of the support rails to a height above a mattress height, a plurality of members in a predominantly horizontal array supported on the corner posts at the height above the mattress height;

the members of the horizontal array being joined together in the array such that the array is capable of supporting as a minimum 200 pounds of weight of an adult human; the array having one or more body-part-receiving spaces between members through which an adult is able to extend his or her body; and some of members configured and disposed to be comfortably clasped by an adult who is in a sitting or kneeling position on said bed.

* * * * *